US006886478B2

(12) United States Patent
Kawasaki

(10) Patent No.: US 6,886,478 B2
(45) Date of Patent: May 3, 2005

(54) AUTOMATED SEWING DEVICE

(75) Inventor: Kiyoshi Kawasaki, Tokyo (JP)

(73) Assignee: Tachi-S Co., Ltd., Tokyo (JP)

( * ) Notice: Subject to any disclaimer, the term of this patent is extended or adjusted under 35 U.S.C. 154(b) by 0 days.

(21) Appl. No.: 10/438,830

(22) Filed: May 16, 2003

(65) Prior Publication Data

US 2004/0226496 A1 Nov. 18, 2004

(51) Int. Cl.[7] ..... D05B 21/00
(52) U.S. Cl. ..... 112/470.07; 112/475.04
(58) Field of Search ..... 112/DIG. 2, 306, 112/470.12, 470.13, 470.27, 153, 470.07, 318, 322

(56) References Cited

U.S. PATENT DOCUMENTS 4,590,876 A * 5/1986 Mencke et al. ..... 112/475.03
5,544,602 A 8/1996 Kawasaki
5,850,792 A * 12/1998 Adamski et al. ..... 112/470.07

* cited by examiner

*Primary Examiner*—John J. Calvert
*Assistant Examiner*—Brian Kauffman
(74) *Attorney, Agent, or Firm*—Browdy and Neimark, P.L.L.C.

(57) ABSTRACT

An automated sewing device capable of neatly feeding a material(s) of easily contractible property to a sewing machine, without the material(s) being curled. In the automated sewing device, blower tubes are arranged so as to allow air to be blown therefrom to the material(s), thereby applying an appropriate degree of air pressure thereto at desired angles. With such blower tube arrangement, air pressure is effectively used for stretching the material(s) outwardly and neatly so as to prevent the same from curling, and also for automatically feeding the material(s) toward the sewing machine.

3 Claims, 4 Drawing Sheets

AUTOMATED SEWING DEVICE

BACKGROUND OF THE INVENTION

1. Field of the Invention

The present invention relates to an automated sewing device for automatically sewing the curved ends of materials together. In particular, the invention is directed to an automated sewing device capable of sewing together the curved ends of thin contractible materials which naturally tend to curl.

2. Description of Prior Art

Basically, a trim cover assembly for a vehicle or automotive seat is formed by sewing together a peripheral cover material with a central cover material, wherein the central cover material is adapted to cover a central seating region of the seat on which a seat occupant's buttocks portion rests and the peripheral cover material is adapted to cover a peripheral vertical wall of the seat surrounding that central seating region of seat. In most cases, the central seating region of seat is of a generally ellipse or circular shape, and therefore, in conformity therewith, the corresponding central cover material is also of a generally ellipse or circular shape and thus has curved end portion. Accordingly, in the process of forming the trim cover assembly, end portion of the peripheral cover material should be aligned and sewn with such curved portion of central cover material, which requires a sewing machine designed to sew those two materials together curvilinearly along their respective curved end portions.

Some automated sewing devices enabling such curvilinear sewing are known. For example, the U.S. Pat. No. 5,544,602 discloses an automated sewing device comprising a movable guide plate having some guide rollers provided on the reverse side thereof and some guide grooves formed in a table on which a sewing machine is mounted. In this prior art, the guide rollers are movably fitted in the guide grooves so that the movable guide plate can be moved along a predetermined path, thereby causing a curved end portion of central cover material placed on the guide plate to be automatically sewn by the sewing machine with and along a curved end portion of peripheral cover material being fed toward the sewing machine.

However, such prior-art automated sewing device has been found defective in that it is troublesome for a worker to securely set the central cover material in position on the guide plate, and further, it is quite annoying labor for the worker to replace the guide rollers and guide grooves by different shapes of guide rollers and grooves according to a size and contour of each different central cover material as well as to a curvature of the curved end portion of the central cover material.

In particular, some of trim cover assemblies for automotive seats use one unitary sheet of thin contractible elastic material in the central cover section thereof. A typical material used in such central cover section is a Tricot knit fabric material or the like. This sort of thin contractible material, when it is cut and trimmed into a predetermined shape of central cover material corresponding to the central cover section of trim cover assembly, naturally tends to curl at the localized end portions thereof into a generally "U" shaped cross-section, as shown in FIG. 10 for example. When such thin material is sewn with other material, a worker needs to feed and stretch it with his or her hands to prevent the materials from natural curling at the peripheral ends thereof, thus resulting in troublesome labor on the worker's part and a poor efficiency for mass production of the trim cover assemblies.

SUMMARY OF THE INVENTION

In view of the above-stated drawbacks, it is a primary purpose of the present invention to provide an improved automated sewing device which allows two materials to be easily sewn together without requiring any movable guide members and other support elements.

In order to achieve such purpose, in accordance with the present invention, there is basically provided an automated sewing device for automatically sewing together a first material and a second material, comprising:

- a table on which one of the first and second materials is to be placed;
- a sewing machine;
- a guide means provided on the table at a point adjacent to the sewing machine, the guide means being so adapted that another of the first and second materials is to be placed and movable thereon in a direction to the sewing machine; and
- a feeding means for feeding the first and second materials to the sewing machine, the automated feeding means including a blower tube means so arranged as to allow air to be blown therefrom to one or both of the first and second materials, applying an air pressure thereto, thereby causing the one or both of first and second materials to neatly feed towards the sewing machine.

Preferably, the blower tube means may comprise at least one blower tube formed from a bendable or flexible metallic tube which can be bent in any desired direction.

It is another purpose of the present invention to allow a thin contractible material to be smoothly fed to the sewing machine, while preventing an end of such material from curling.

For that purpose, in the above-described automated sewing device, a stretching means is provided, which works to stretch either end of the first material and end of the second material outwardly, the stretching means comprising at least one blower tube means so arranged as to allow air to be blown therefrom in a direction transversely of a direction in which the first and second materials are to be fed to the sewing machine.

The afore-stated blower tube means and stretching means are effective in causing the first and second materials to smoothly fed to a conventional end alignment control means provided on both of the table and guide means in this sort of automated sewing device, wherein the end alignment control means is operable to automatically keep both end portions of the first and second materials in alignment with each other before they are sewn by the sewing machine Other various features and advantages will become apparent from reading of the description hereinafter, with reference to the annexed drawings.

DETAILED DESCRIPTION OF PREFERRED EMBODIMENT OF THE INVENTION

Referring to FIGS. 1 to 11, there is illustrated one preferred mode of automated sewing device as generally designated by (S).

Figure 9:
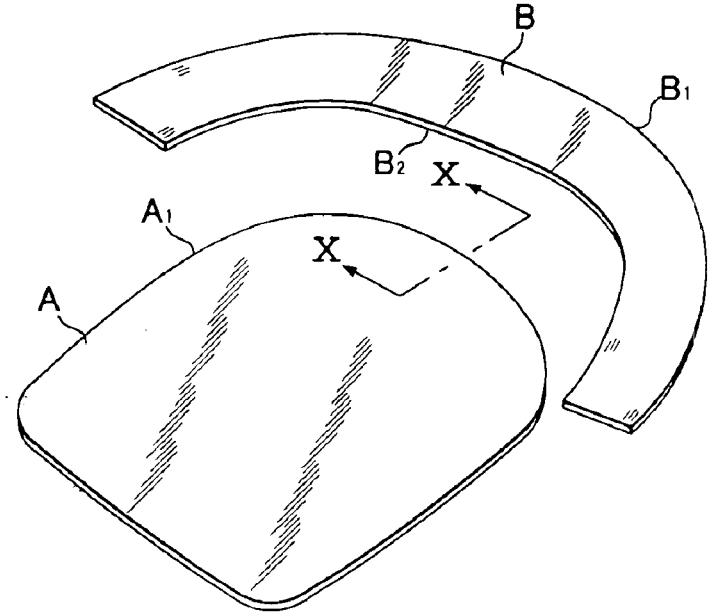
FIG. 9 is a schematic perspective view showing a central cover material and peripheral cover material which are to be sewn together by the automated sewing device.
Figure 10:
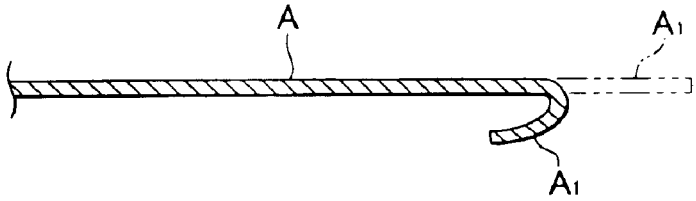
FIG. 10 is a sectional view taken along the line X—X in FIG. 9, showing a curling property of the central cover material.

At first, reference is made to FIG. 9 which shows a central cover material (A) which is a thin material having an elastic and contractible property, such as a Tricot fabric material, and an arcuate peripheral cover material (B), by way of example, both of which are to be sewn together by the automated sewing device (S) to form a trim cover assembly adapted to cover outer surfaces of automotive seat. The central cover material (A) is formed in generally a circular or ellipse shape so as to cover a generally circular or ellipse central seating region of automotive seat on which a buttocks portion of seat occupant are to rest, whereas the peripheral cover material (B) is formed in an arcuate shape so as to cover a peripheral vertical region of the automotive seat surrounding the central seating region. Hence, the central cover material (A) includes a curved end portion (A1) and the peripheral cover material (B) has an outward curved end (B1) which is generally equal in curvature to the curved end portion (A1). As stated in the description of prior art and as shown in FIG. 10, the thin central cover material (A), by the reason that it is of a contractible property, tends to naturally curl inwardly at its end portion (A1).

Figure 1:
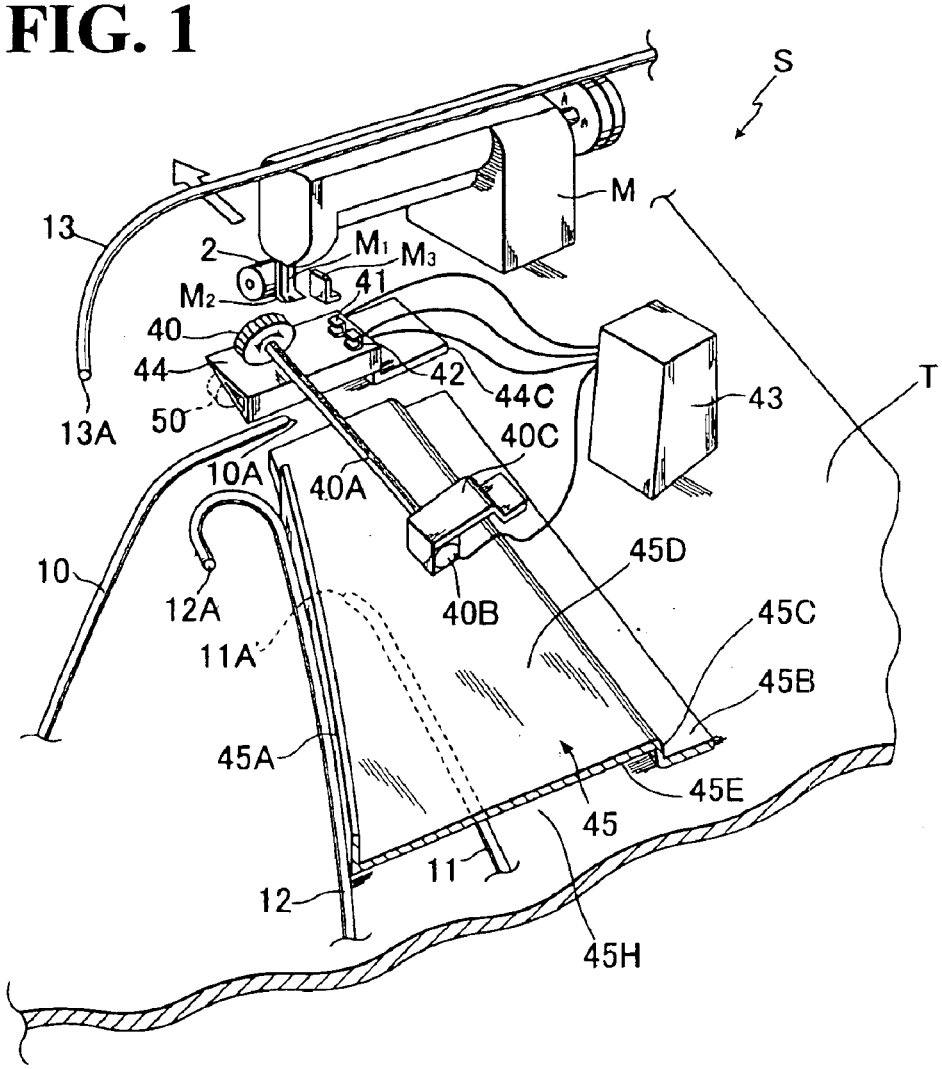
FIG. 1 is a partly broken perspective view showing an automated sewing device in accordance with the present invention.

As shown in FIG. 1, the automated sewing device (S) includes a conventional sewing machine (M) mounted on a table (T), which is provided with a sewing needle (M1), a pressure foot piece (M2) and an end alignment guide (M3) as known in the art.

In accordance with the automated sewing device (S), a first sloped guide member (44) is fixedly mounted on the table (T) in the proximity of the sewing machine (M), and a second sloped guide member (45) is fixedly mounted on the table (T) so as to be spaced apart from the first sloped guide member (44), as illustrated in FIG. 1. Thus, a certain transversely extending space is defined between the first and second sloped guide member (44) (45).

Figure 4:
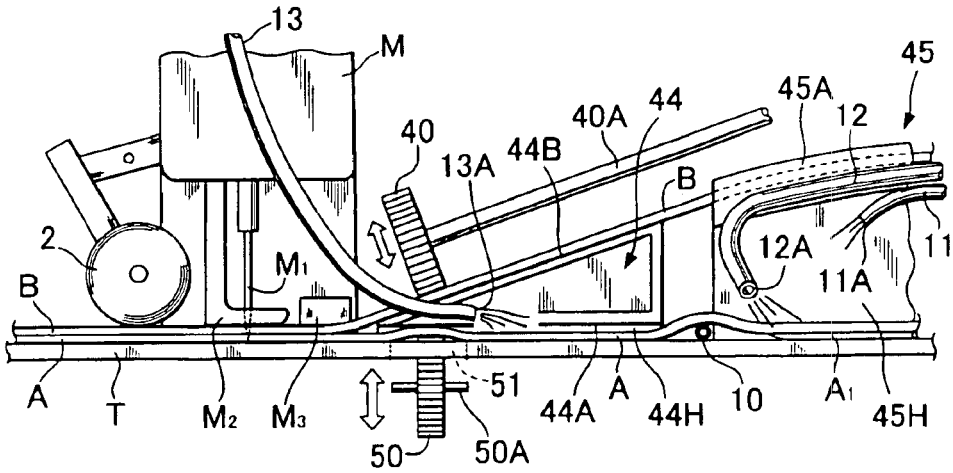
FIG. 4 is a partly broken front view showing the same state as shown in FIG. 3.

As best seen in FIG. 4, the first sloped guide member (44) is formed in a triangle shape in section so as to have a sloped upper surface (44B), a horizontal lower surface (44A) and a securing plate (44C). The first sloped guide member (44) is fixedly supported by the securing plate (44C) upon the table (T), such that the horizontal lower surface (44A) thereof is spaced from the horizontal flat surface of table (T) in parallel therewith, thus defining a passage space (44H) between the surface (44A) and table (T), wherein the passage space (44*h*) allows the curved end portion (A1) of central cover material (A) to move therethrough.

On the other hand, the second sloped guide member (45) is formed to have: a sloped flat portion (45D); an upwardly extending portion (45A) defined in one lateral side of the sloped flat portion (45D) a securing portion (45B) defined in another lateral side of the sloped flat portion (45D); and a vertical transit region (45C) between the flat portion (45D) and securing portion (45B). As seen from FIGS. 1 and 2, the securing portion (45B) is fixed on the table (T) so that the flat portion (45D) extends slanted above the table (T) via the vertical transit region (45C), thus defining a passage space (45H) for allowing the central cover material curved end portion (Al) to move therethrough.

Figure 5:
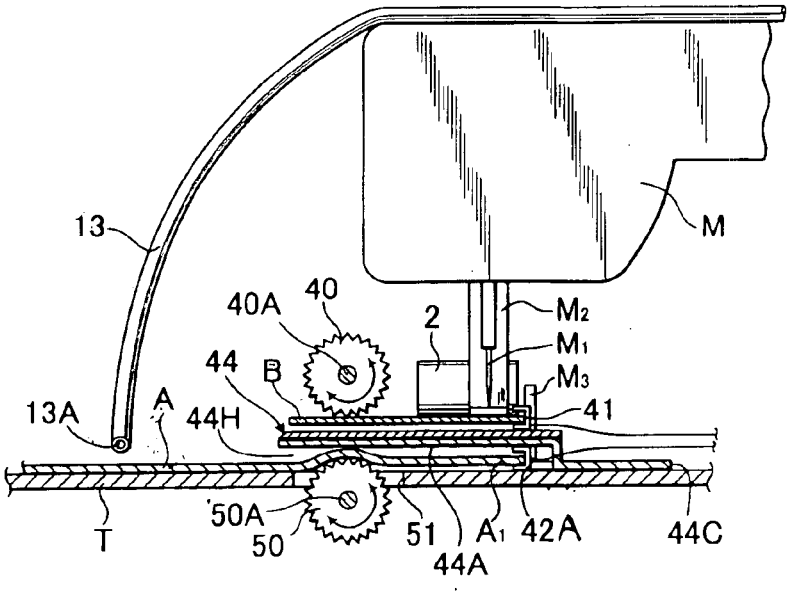
FIG. 5 is a partly broken sectional view showing a part of principal portion of the automated sewing device.

As can be seen from FIGS. 1 and 5, a pair of upper sensors (41) (42) , each having a channel cross-section, are provided on the sloped upper surface (44B) of the first sloped guide member (44), and further, a lower sensor (42A) of a likewise channel cross-section is provided in the passage space (44H) between the lower surface (44A) of first sloped guide member (44) and table (T). As shown in FIG. 1, the two upper sensors (41) (42) are electrically connected with a control unit (43) which has a computer and associated electronic elements provided therein, through not shown. Both sensors (41) (42) are so designed to detect an amount of dislocation of the peripheral cover material curved end portion (B1) in a direction to and away from the sensors and send an electric signal indicative of that dislocation amount to the control unit (43). Also, the lower sensor (42A) is electrically connected with the control unit (43) and so designed to detect an amount of dislocation of the central cover material curved end portion (AI) in a direction thereto and therefrom and send an electric signal indicative of the dislocation amount to the control unit (43).

Designations (40) and (50) denote an upper guide roller and a lower guide roller, respectively. As in FIG. 1, a shaft (40A) is connected with the upper guide roller (40) at one end thereof and also connected with a motor (40B) at another end thereof, such that the guide roller (40) is normally positioned above the sloped surface (44B) of the first sloped guide member (44). The motor (40B) is supported by a bracket (40C) fixed to the second sloped guide member (45) and electrically connected with the control unit (43). The lower guide roller (50) is positioned below the table (T). Though not shown, the shaft (50A) fixed to that guide roller (50) is connected with another motor which is electrically connected with the control unit (43). As best seen from FIG. 4, a hole (51) is formed in the table (T) at a point corresponding to the lower guide roller (50).

The sensor system (41, 42, 42A), guide roller system (40, 50) and control unit (43) are provided as a known end alignment control means for automatically causing both two curved end portions (A1) (B1) respectively of those two cover materials (A) (B) to be aligned with each other constantly toward the sewing machine (M), as disclosed in the Japanese Laid-Open Patent Publication No. 2001-359540. In brief, such end alignment control system works to automatically move the central and peripheral cover materials (A) (B) responsive to the corresponding sensors (41, 42) detecting any slight dislocation therefrom in order that both two curved end portions (A1) (B1) respectively of those two cover materials (A) (B) are kept in alignment with each other and fed to the sewing machine (M) and sewn together, with a constant margin given from a seam along the curved end portions (A1) (B1). For further information and details thereof, reference should be made to the Japanese Publication No. 2001-359540.

In accordance with the present invention, a feeding roller (2) is provided, which has a length greater than a width-wise length of a sewn portion of the two end portions (A1) (B1) which has undergone sewing operation by the sewing machine (M), including a margin from a seam created along the two end portions (A1) (B1). Thus, as will be explained, such sewn portion of the two end portion (A1) (B1) is entirely pressed by the feeding roller (2) against the table (T), thereby positively preventing the sewn portion from curling. As best shown in FIG. 4, the feeding roller (2) is connected with the sewing machine (M) and disposed adjacent to the sewing needle (M1) and situated on a side opposite to the first and second guide members (44) (45) in relation to the sewing machine (M). Though not shown, the feeding roller (2) is provided with a motor and may be rotated by the motor at a predetermined constant speed.

With the soft contractible property of central cover material (A) in view, the present invention contemplates a stretching means for stretching the central cover material end portion (A1) outwardly so as to prevent the same from natural curling. Also, the invention contemplates an auxiliary feeding means for assisting in the feeding of the central cover material (A) in a predetermined direction in conjunction with the lower guide roller (50), thereby making it smooth and easy to feed the central cover material (A) toward the sewing machine (M) without any slack and twisting occurred therein.

Figure 6:
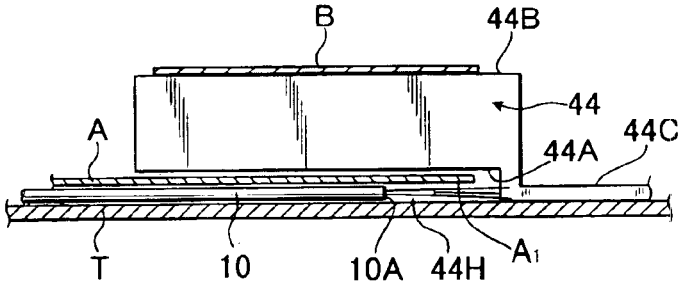
FIG. 6 is a sectional view taken along the line VI—VI in FIG. 3.

Thus, as the foregoing stretching means for stretching the central cover material curved end portion (A1), there may be provided a transverse blower tube (10) adapted to allow air to be blown in a direction transversely of a path through which the curved end portion (A1) is to be fed toward the sewing machine (M). Specifically, as illustrated, the transverse blower tube (10) has a vent (10A) defined in the free end portion thereof and extends on and along the table (T). Such free end portion of transverse blower tube (10) is shown to extend in and along the space between the first and second guide members (44) (45), wherein that particular space extends in a direction transversely of the two passage spaces (44H) (45H) respective of the first and second guide members (44) (45H). In other words, the transverse blower tube (10) extends transversely of a path along which the end portion (A1) of central cover material (A) is to be fed to the sewing machine (A). But, as best seen in FIG. 6, it is important that the free end portion of blower tube (10) extends from one side (i.e. the left side) of the first sloped member (44) and terminates in a predetermined point distant from another opposite side (i.e. the right side) of the same member (44), wherein, at such predetermined point, the vent (10A) of transverse blower tube (10) is situated in a particular region where the central cover material end portion (A1) tends to curl downwards to the table (T) when it is fed through the two sloped guide members (44) (45) to the sewing machine (M). As can be seen from FIG. 6, the central cover material curved end portion (A1) will ride over the free end portion of transverse blower tube (10). While not shown, another end of the blower tube (10) opposite to that free end portion is connected with an air supply device having computerized elements, and by operation of the air supply device, an appropriate amount of air is supplied into the tube (10) and blown therethrough outwardly.

On the other hand, the auxiliary feeding means for assisting in the feeding of the central cover material (A) in a predetermined direction in conjunction with the lower guide roller (50) may be embodied by a blower tube arrangement which, by way of example, comprises: a first blower tube (11) disposed so as to allow air to be blown to the central cover material (A) in a forward blowing direction to the sewing machine (M), thereby causing the cover material (A) to smoothly move toward the sewing machine (M) without slack and twisted regions created therein; and a pair of second and third blower tubes (12) (13) are disposed so as to allow air to be supplied therethrough and impinged on the central cover material (A) in a backward blowing direction opposite to the afore-stated forward blowing direction of first blower tube (11).

Figure 2:
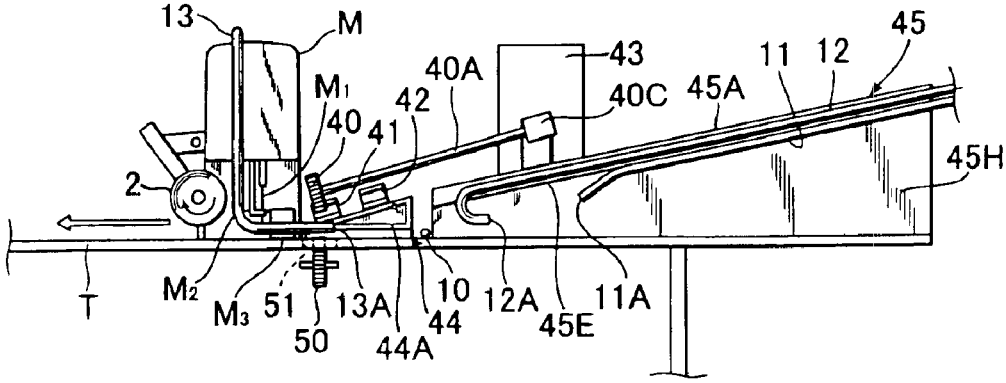
FIG. 2 is a partly broken front view of the automated sewing device.

Specifically, in the illustrated embodiment, the first blower tube (11) has a vent (11A) defined in the free end portion thereof and extends along the reverse surface (45E) of sloped flat portion (45D) of second guide member (45) in a direction to the second guide member (44) and sewing machine (M), as shown in FIGS. 1 and 2. The free end portion of first blower tube (11) is shown to be bent downwardly and oriented toward the table (T), such that the vent (11A) of the former is pointed by a predetermined angle to the latter.

The second blower tube (12) extends alongside of the vertically extending portion (45A) of second guide member (45) toward a side where the first guide member (44) and sewing machine (M) are located. But, as shown, the free end portion of that second blower tube (12) is curved backwardly at a point in front of the space between the first and second guide members (45) (44), while extending downwardly to the table (T), in a direction opposite to the afore-stated side where the first guide member (44) and sewing machine (M) are located.

The third blower tube (13) extends from the sewing machine (M) and the free end portion of the third blower tube extends downwardly to the table (T) while being curved in a direction to the second blower tube (12) (i.e. in a direction opposite to the side where the first guide member (44) and sewing machine (M) are located).

Figure 3:
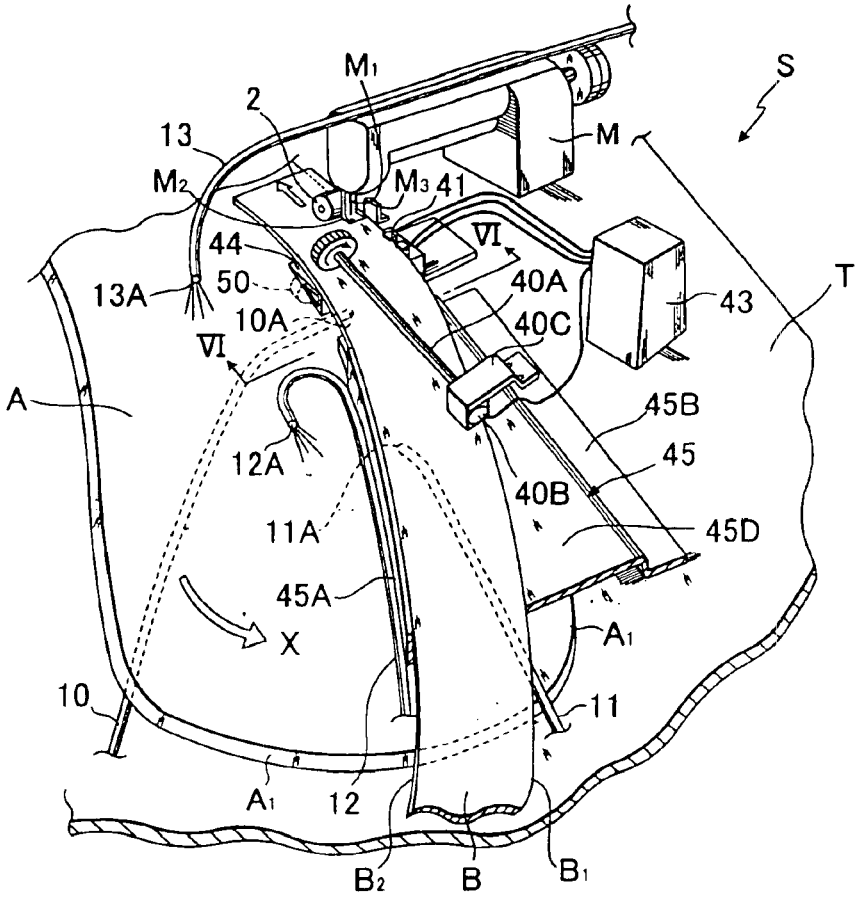
FIG. 3 is a partly broken perspective view showing the state where a central cover material and a peripheral cover material are being fed to and sewn together by a sewing machine in the automated sewing device.

With such arrangement of three blower tubes (11) (12) (13), it is seen that a forward air pressure is applied from the first blower tube (11) to one side of the central cover material (A) in a forward direction to the sewing machine (M), while a backward air pressure is applied from the second and third blower tubes (12) (13) to another opposite side of the central cover material (A) in a backward direction opposite to that forward direction, thereby causing the central cover material (A) to automatically rotate anticlockwise on the table (T) as indicated by the arrow in FIG. 3, so that the curved end portion (A1) of central cover material (A) is automatically sewn with and along the curved end portion (B1) of peripheral cover material (B). This eliminates the need for a worker to use his or her hands to retain the central cover material (A) on the table (T).

It is noted that all the three blower tubes (11) (12) (13) are formed from a bendable metallic material and may be bent and/or curved and retained in any desired direction and by any desired angle, depending on the size of the central cover material (A) and the curvature of the curved end portion (A1). The transverse blower tube (10) may also be formed from such bendable metallic material. While not shown, those three blower tubes (11) (12) (13) are connected with a conventional air supply device having a computerized control system programmed to control a timing of supplying air into each of those three blower tubes (11, 12 and 13) and also adjustingly control a degree of air pressure for each of the blower tubes.

Figure 7:
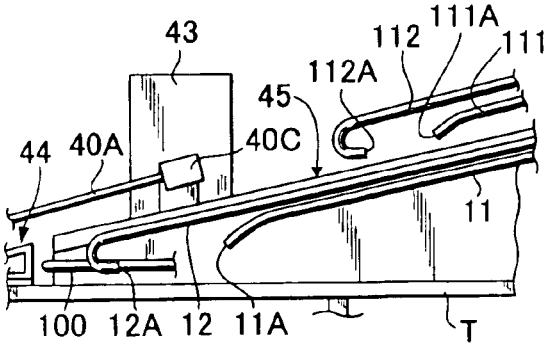
FIG. 7 shows an alternative mode wherein two additional blower tubes are provided above a second guide member.

As suggested in FIG. 7, a fourth blower tube (111) and a fifth blower tube (112) may be provided above the second sloped guide member (45) so as to facilitate the ease with which the curved peripheral cover material (B) is moved to the sewing machine (M) in cooperation with the upper guide roller (40). In this mode, likewise as in the first blower tube (11), the free end portion of the fourth blower tube (111) may be bent downwardly and oriented to the second sloped guide member (45) such that the vent (111A) of the former is pointed by a predetermined angle to the latter, and, likewise as in the second blower tuber (12), the free end portion of the fifth blower tube (112) may be bent downwardly to the second sloped guide member (45) while being curved in a direction opposite to the side where the first sloped guide member (44) and sewing machine (M) are located. Accordingly, it may be so arranged that a forward air pressure is applied from the fourth blower tube (111) to one side of the peripheral cover material (B) (near to the outward end (B1)), while simultaneously, a backward air pressure is applied from the fifth blower tube (112) to another side of the peripheral cover material (B) (near to the inward end (B2)), thereby giving an anticlockwise rotation force to the peripheral cover material (B) and assisting in smooth and precise feeding of that peripheral cover material (B) toward the sewing machine (M). Of course, this is quite effective in the case where such peripheral cover material (B) is formed from a contractible material, such as a Tricot fabric, which tends to easily curl.

Figure 8:
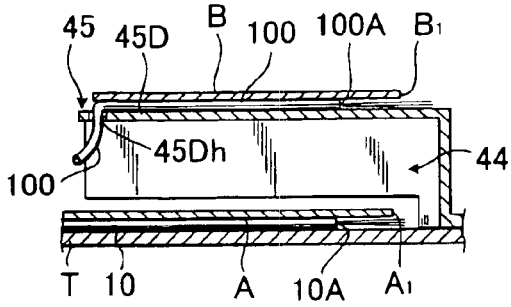
FIG. 8 shows a further alternative mode wherein an additional transverse blower tube is provided on the second guide member.

Additionally, as suggested in FIG. 8, another transverse blower tube (100) may be provided at the second sloped guide member (45). According to this mode, a hole (45Dh) is formed in the sloped flat portion (45D) of the second sloped guide member (45), and a free end portion of the blower tube (100) passes upwardly through the hole (45D) and extends on and along the upper surface of that sloped flat portion (45D) in a direction transversely of the second sloped guide member (45). In other words, likewise as in the previously stated transverse blower tube (10), the free end portion of the present transverse blower tube (100) extends transversely of a path along which the peripheral cover material (B) is to be fed to the sewing machine (A). But, as in FIG. 8, it is important that the free end portion of blower tube (100) extends from one side (i.e. the left side) of the second sloped guide member (45) and terminates in a predetermined point distant from another opposite side (i.e. the right side) of the same member (45), wherein, at such predetermined point, the vent (10A) of transverse blower tube (100) is situated in a particular region where the peripheral cover material end portion (131) tends to curl downwards. It can be observed that the peripheral cover material (B) rides over the free end portion of transverse blower tube (10). While not shown, another end of this particular blower tube (100) opposite to that free end portion is connected with an air supply device having computerized elements, and by operation of the air supply device, an appropriate amount of air is supplied into the tube (10) and blown therethrough outwardly at a predetermined degree of air pressure.

Of course, the transverse blower tube (10) may be provided above and spaced apart from the table (T) so that the end portion (A1) of central cover material (A) may be fed therebetween. In that case, air is blown from the vent (10A) of the tube (10) to apply an appropriate degree of air pressure to the upper surface of the central cover material end portion (A1). Thus, that end portion (A1) is effectively prevented against curling. The same goes for another transverse blower tube (100).

Now, a description will be made of operation of the above-described automated sewing device (S).

As can be seen from FIGS. 3 and 5, at first, the cental cover material (A) is placed on the table (T) such that one end of its curved end portion (A1) is set under the sewing needle (M1) and contacted with the end alignment member (M3), while being also disposed in the sensor (42A). Then, likewise, the peripheral cover material (B) is placed on the first and second guide members (44) (45) such that one end of its curved end portion (B1) is juxtaposed on that of the central cover material end portion (A1) under the sewing needle (M1) and contacted with the end alignment member (M3), while being disposed in the two sensors (41) (42).

Upon turning on of a switch (not shown), the sewing machine (M) starts to sew together the two juxtaposed curved end portions (A1) (B1) of central and peripheral cover materials (A) (B) with a fixed margin to seam. During the sewing operation, as understandable from FIGS. 4 and 5, when the curved end portion (B1) of peripheral cover material (B) is dislocated beyond a fixed point in the corresponding two sensors (41) (42), the upper guide roller (40) is immediately lowered to contact with the peripheral cover material (B) and rotated clockwise and anticlockwise so as to return the curved end portion (B1) to the fixed point, after which, the guide roller (40) is moved upwardly out of contact with the peripheral cover material (B). On the other hand, when the curved end portion (A1) of central cover material (A) is dislocated beyond a fixed point in the corresponding sensors (42A), the lower guide roller (50) is immediately moved upwardly to contact with the peripheral cover material (B) and rotated clockwise and anticlockwise so as to return the curved end portion (B1) to the fixed point, after which, the guide roller (50) is lowered out of contact with the peripheral cover material (B). In that way, both two curved end portions (A1) (B1) are precisely aligned and sewn together, with a constant margin from a sewn line. At the same time, in accordance with the present invention, an appropriate degree of air pressure is applied from the transverse blower tube (10) to stretch the central cover material end portion (A1) outwardly, thereby preventing the same (A1) from curling downwardly to the table (T), as shown in FIG. 6, and, simultaneous therewith, a forward air pressure being applied from the first blower tube (11) causes the central cover material (A) to move in a forward direction to the sewing machine (M), while a backward air pressure being applied from the second and third blower tubes (12) (13) gives a force to cause anticlockwise rotation of the central cover material (A) in cooperation with the forwardly applied air pressure from the first blower tube (11) as in FIG. 3. With such three-point air blowing arrangement of the three blower tubes (11) (12) (13), the central cover material (A) is rotated in the clockwise direction as indicated by the arrow in FIG. 3 so that the central cover material (A) per se is properly pressed against and rotated on the table (T), thereby smoothly and precisely feeding the curved end portion (A1) of central cover material (A) toward the sensor (42A) and sewing machine (M), without slack and twisting portions created in the central cover material (A).

Figure 11:
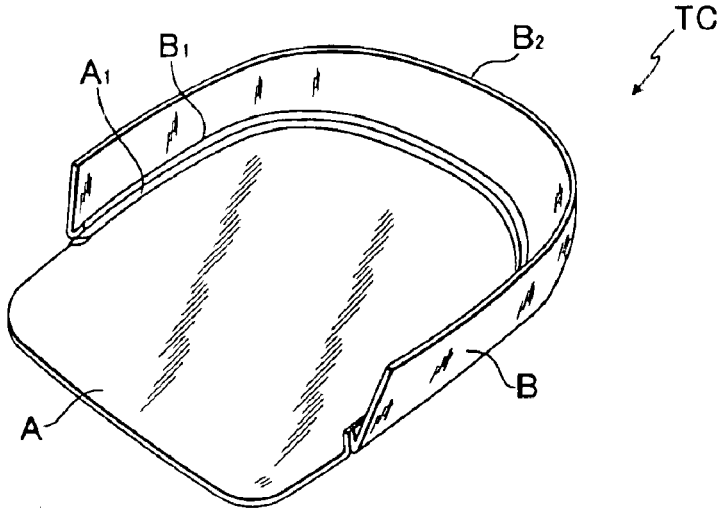
FIG. 11 is a schematic perspective view of a resulting trim cover assembly formed by the automated sewing device.

FIG. 11 shows a resulting trim cover assembly (TC) in which the curved end portion (B1) of peripheral cover material (B) has been sewn with and along the curved end portion (A1) of central cover material (A) by the above-described automated sewing device (S) and the thus-sewn product is turned over into the illustrated three-dimensional configuration, with the peripheral cover section (at B) extending upright from the horizontally extending central cover section (at A).

Accordingly, in accordance with the present invention, there is no need to provide any guide plate on the table (T), which movably supports the central cover material (B), as with the prior art. Further, the central cover material (A) is automatically stretched flat upon the table (T) on the table (T) and positively fed towards the sewing machine (M) by air pressure being applied from the transverse blower tube (10) and three blower tubes (11, 12 and 13), without any curling, slack and twisted portions created in either of the two cover materials (A) (B). Of course, the peripheral cover material (B) may also be automatically stretched flat on the second sloped guide member (45) and positively fed towards the sewing machine (M) by air pressure applied from additional transverse blower tube (100) and additional two blower tubes (111 and 112). Thus, there is eliminated troublesome labor and skill on the part of workers to change such guide plate and manually stretch the contractible cover material as found in the prior art.

It should be understood that the present invention is not limited to the illustrated embodiments, but any modification, replacement and addition may be applied thereto without departing from the scopes of the appended claims. For example, the three blower tubes (11, 12 and 13) are not limitative, but instead thereof, only one blower tube will suffice for the purpose of the present invention, in which case, one blower tube may be provided, likewise as in one of the second and third blower tubes (12) (13), with the vent thereof being oriented in a proper direction opposite to a side where the sewing machine (M) is located.

What is claimed is:

1. An automated sewing device for automatically sewing together a first material and a second material, comprising:

a table on which one of said first and second materials is to be placed;

a sewing machine;

a guide means provided on said table at a point adjacent to said sewing machine, said guide means being so adapted that another of said first and second materials is to be placed and movable thereon in a direction to said sewing machine; and a blower tube means formed from a bendable metallic material, said blower tube means being bendable in a desired direction so as to allow air to be blown therefrom to one or both said first and second materials, applying an air pressure thereto, thereby causing said one or both of said first and second materials to neatly feed in a predetermined direction inclusive of a direction toward said sewing machine.

2. The automated sewing device as claimed in claim 1, wherein said blower tube means comprises a plurality of blower tubes disposed at different points from one another upon said automated sewing device so as to allow said air to be blown therefrom to said one or both of said first and second materials in different directions and angles, thereby causing said one or both of said first and second materials to neatly feed in said predetermined direction inclusive of said direction toward said sewing machine.

3. The automated sewing device as claimed in claim 1, wherein said blower tube means comprises a plurality of blower tubes, arranged so that air is blown from each said plurality of blower tubes to said one or both of said first and second materials corresponding with movement of said one or both of said first and second materials which is caused by feeding and sewing of said sewing machine, so that said one or both of said first and second materials are fed in said predetermined direction inclusive of said direction toward said sewing machine.

* * * * *